US010385609B2

(12) United States Patent
Mader et al.

(10) Patent No.: US 10,385,609 B2
(45) Date of Patent: Aug. 20, 2019

(54) METHOD AND DEVICE FOR PRODUCING THERMOPLASTIC SPACERS

(71) Applicant: LISEC AUSTRIA GMBH, Seitenstetten (AT)

(72) Inventors: Leopold Mader, Neuhofen/Ybbs (AT); Leopold Karner, Krummnussbaum (AT); Manuel Schorghuber, St. Peter/Au (AT)

(73) Assignee: LISEC AUSTRIA GMBH, Seitenstetten (AT)

( * ) Notice: Subject to any disclaimer, the term of this patent is extended or adjusted under 35 U.S.C. 154(b) by 370 days.

(21) Appl. No.: 15/108,450

(22) PCT Filed: Jan. 26, 2015

(86) PCT No.: PCT/AT2015/000008

§ 371 (c)(1),
(2) Date: Jun. 27, 2016

(87) PCT Pub. No.: WO2015/113080

PCT Pub. Date: Aug. 6, 2015

(65) Prior Publication Data

US 2016/0326794 A1 Nov. 10, 2016

(30) Foreign Application Priority Data

Jan. 28, 2014 (AT) ..... 59/2014

(51) Int. Cl.
*E06B 3/663* (2006.01)
*E06B 3/673* (2006.01)
*E06B 3/677* (2006.01)

(52) U.S. Cl.
CPC ..... *E06B 3/67326* (2013.01); *E06B 3/66328* (2013.01); *E06B 3/66347* (2013.01);
(Continued)

(58) Field of Classification Search
CPC ..... E06B 3/67326; E06B 3/67391; E06B 3/66347
See application file for complete search history.

(56) References Cited

U.S. PATENT DOCUMENTS 6,378,586 B1 * 4/2002 Lafond ..... E06B 3/6733 156/101
2012/0180936 A1 7/2012 Schuler

FOREIGN PATENT DOCUMENTS

DE 42 31 424 A1 3/1994
EP 1 002 925 A2 5/2000
(Continued)

OTHER PUBLICATIONS

Machine Translation of EP1002925.*
International Search Report, dated Apr. 23, 2015, from corresponding from PCT Application.

*Primary Examiner* — Christopher T Schatz
(74) *Attorney, Agent, or Firm* — Young & Thompson

(57) ABSTRACT

When producing insulating glass including at least two panes of glass (1) and at least one spacer of thermoplastic material arranged between the panes of glass, to seal the beginning (4) and the end (5) of the strand (2) of thermoplastic material the thermoplastic material is compressed with the aid of jaws placed against the side faces of the strand. In the region of the joint thus formed between the beginning and the end of the strand forming the spacer, the width of the strand is reduced with the aid of a compression die with a convexly curved active face such that a depression is created. This depression has the effect that, after the assembly of an insulating glass blank, placing a second pane of glass onto the free edges of the strand produces an opening that allows a pressure equalization during the subsequent compression of the insulating glass blank.

4 Claims, 8 Drawing Sheets

Figure 1:
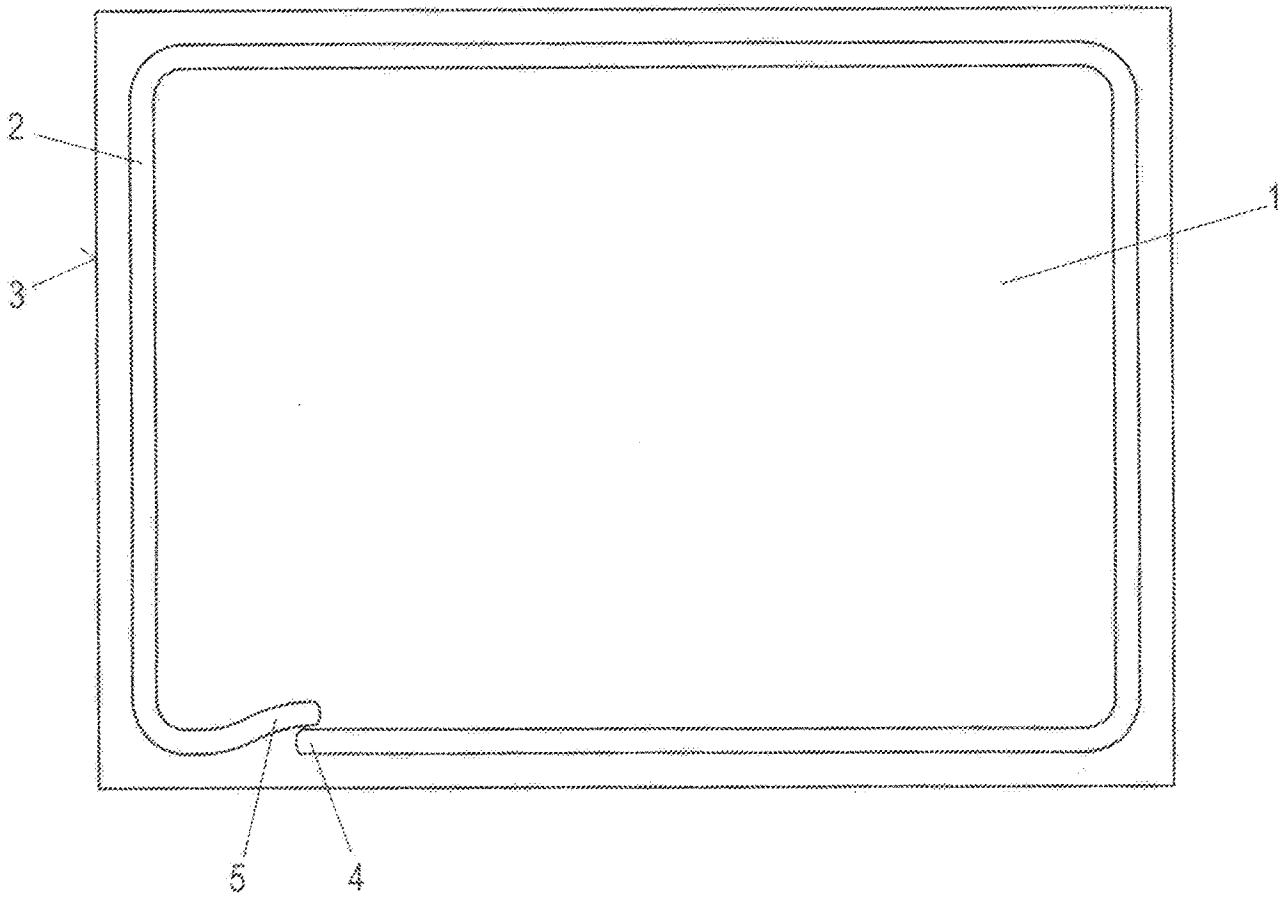

(52) U.S. Cl.
CPC ..... *E06B 3/6775* (2013.01); *E06B 3/67334* (2013.01); *E06B 3/67339* (2013.01); *E06B 3/67391* (2013.01)

(56) References Cited

FOREIGN PATENT DOCUMENTS

| | | | |
|---|---|---|---|
| EP | 0 805 254 | B1 | 11/2002 |
| WO | 94/06992 | A1 | 3/1994 |

* cited by examiner

METHOD AND DEVICE FOR PRODUCING THERMOPLASTIC SPACERS

The invention relates to a method for producing spacers made of thermoplastic material in the course of the production of insulating glass and a device with which the method according to the invention can be carried out.

During the production of insulating glass with spacers made of thermoplastic material, for example, the procedure is such that a strand made of thermoplastic material, which is to form the spacer, is mounted ("applied") on a glass pane, whereby the strand is located some distance ("recess") from the edge of the glass pane, i.e., is mounted offset inward relative to the edge of the glass pane. After the strand, which forms the spacer, has been mounted, the beginning and the end of the strand are connected to one another by the overlapping ends of the strand being compressed.

After the spacer made of thermoplastic material has been closed in this way, a second glass pane is put into place (the insulating glass blank is assembled), and the insulating glass blank is compressed to form a desired distance in order to achieve the provided outside thickness (distance between the outside surfaces of the glass panes and the insulating glass blank) from one another.

When compressing the insulating glass blank, the distance of the glass panes from one another is decreased, so that in the interior of the insulating glass blank, overpressure can build up, which is undesirable.

In order to avoid this, EP 0 805 254 B1 proposes applying the strand made of thermoplastic material in sections with decreased width, so that after the assembly and before the compression of the insulating glass blank, an opening remains free, through which opening gas or air from the inner space of the insulating glass blank can escape, when the latter is compressed.

In EP 0 805 254 B1, it is also proposed to form the section of the strand made of thermoplastic material with reduced width in such a way that the amount of thermoplastic material, which is extruded, is decreased in this area.

The method that is known from EP 0 805 254 B1 is disadvantageous to the extent that it is a comparatively expensive procedure to form the spacer in sections with decreased width. Moreover, the known method often produces leaky joints since the compression is ineffective there.

DE 42 31 424 A (=WO 94/06992A) discloses a method for producing insulating glass panes, whose glass panels are kept apart by a plastic spacer and are glued to one another. The insulating glass panes are assembled by the strand-shaped spacers first being mounted on a first glass panel along the edges thereof, then the remaining gaps between the ends of the spacer being sealed. At least one of the two glass panels is elastically bent along one portion of the periphery thereof and connected to the other glass panel with the spacer in the sense that a gap remains open between the spacer and the second glass panel in the area of the bend. Then, the glass panels are compressed with one another, and the bend of the other glass panel is reversed. DE 42 31 424 A also discloses a tool for closing the gaps between the ends of the spacer. This tool comprises a first feed part, which is placed on the horizontal section of the spacer, a second feed part, which is placed on the vertical section of the spacer, as well as wedge-shaped counter bearings, which are placed on the ends of the spacer oriented from the inside in the direction opposite to the feed parts, so that the ends of the spacer are clamped between the feed parts, on the one hand, and the counter bearing, on the other hand.

Because of the common pressure of the feed parts and the counter bearing, the gap in the spacer is to be easily and reliably closed while maintaining the right angle between the two sections of the spacer that meet there. DE 42 31 424 A also mentions a hold-down clamp, which can be placed perpendicular to the glass panel on the side of the spacer that is still free. With this hold-down clamp, however, no depression is made in the spacer. This is also unnecessary, since during compression of the insulating glass pane, pressure compensation can be carried out in the area of the bent-away part of the second glass panel.

From EP 1 002 925 A, it is known to take measures with a thermoplastic spacer that allow pressure compensation, as compression of insulating glass is taking place, so that in the interior of the pressed insulating glass, overpressure is avoided. To this end, according to EP 1 002 925 A, at at least one point of the thermoplastic spacer, which is sprayed onto one of the glass panes, a flat depression is provided. The flat depression is produced by deformation in some places of the spacer in the direction toward the glass pane, onto which the spacer has been sprayed. In this case, the spacer is deformed in the area of the depression to the extent that the spacer is deformed to form an insulating glass pane during compression of the packet that consists of glass panes and spacers. The free surface that faces the second glass pane in the area of the depression is preferably at a distance from the glass pane, onto which the spacer is sprayed, which corresponds to the distance between the two glass panes in the finish-pressed insulating glass. In this case, it is advantageous that as a result—unlike in notches in the spacer—an insulating glass pane is obtained, whose spacer has the same properties and dimensions over its entire length.

It has already been proposed (EP 805 254 A) to provide at least one notch in the thermoplastic spacer sprayed onto the one glass pane in its side that faces the second glass pane, for the purpose of allowing pressure compensation during pressing of the insulating glass. Such notches in the one side of the spacer produce, however, a pressure compensation opening with an only small cross-sectional area, so that in the case of the target short cycle times, the pressure compensation is incomplete, and overpressure continues to exist in the pressed insulating glass. In the method that is known from EP 805 254 A, it is disadvantageous that in the area of the depressions, which are to be produced by decreasing the width of the spacer even during spraying of the same on the glass pane, ultimately "material," namely thermoplastic plastic, is lacking.

A method for producing insulating glass, in which a strand that is composed of two partial strips is provided as a spacer, is known from US 2012/018936 A1. In the area of the ends of the strand that forms the spacer, the ends are designed with varying thicknesses crosswise to the plane of the insulating glass, so that ends designed wedge-shaped are produced obliquely to the plane of the insulating glass. During compression of the insulating glass, the ends are connected to one another. In order to allow pressure compensation during compression of the insulating glass, one of the two glass panes is bent away in the area of one of its corners, according to US 2012/0180936 A1, in order to provide an opening for the pressure compensation.

The object of the invention is to propose a method and a device for implementing the method, with which at least one pressure compensation opening can be formed in a simple and reliable way between spacers and glass panes even when connecting the ends of the strand that forms the spacer.

This object according to the invention is achieved with a method that has the independent claim's features that are directed toward the method.

Insofar as the device is concerned, the object underlying the invention is achieved with a device that has the independent claim's features that are directed toward the device.

Additional features of the invention are subjects of the subclaims.

In the method according to the invention, it is advantageous that the section of the spacer with decreased width is formed when the beginning and the end of the applied spacer are connected to one another, i.e., the spacer is closed. In this case, it is advantageous that during the production of depressions, the spacer is supported laterally when its ends are connected to one another. Undesirable deformations of the spacer are thus avoided. This advantageous effect occurs since the jaws, with which the ends of the spacer are connected to one another, and the compression die, with which the depression is generated in the spacer, engage at the same point on the spacer. The jaws prevent the spacer from deforming; for example, the glass pane increases in width in the direction of the plane.

In practice, when implementing the method according to the invention for producing a spacer from a strand that is applied on a glass pane and that is made of thermoplastic material, which forms the spacer, the procedure is, for example, as follows:

A strand made of thermoplastic material is applied on a glass pane, which is oriented, for example, essentially vertically (inclined backward by a few degrees). The beginning and the end of the strand come to rest at a distance from a corner of the glass pane and overlap one another. When the strand, which forms the spacer, is applied, the spacer is applied at some distance from the edge of the glass pane, so that an edge joint that is open toward the outside forms in the insulating glass blank, which edge joint is then filled with sealing compound (sealed).

In order to close the spacer, the beginning and the end of the strand that forms the spacer are pressed by jaws placed at the beginning and the end of the strand from both sides. Simultaneously with the compression or with some time offset, then with use of a die that is advanced crosswise to the plane of the glass pane between the jaws, which are placed at the beginning and the end of the strand, a depression, i.e., an area in which the spacer has a decreased width, is produced by deformation of the strand in the latter.

In this case, a die that has a convex, curved, forward front surface engaging on the strand is preferably used, so that a somewhat cavity-shaped recess is formed in the strand. The depression is located in the free lateral surface of the strand, i.e., in the lateral surface of the strand, which is facing away from the glass pane, on which the strand has been mounted.

The depressions are preferably curved in side view. The curvature is in particular at least approximately in the shape of a circular arc. Depressions with rectangular or trapezoidal cross-sections are also considered, but can be problematic, since in the area of the corners, air pockets can develop during compression.

In the area of the (cavity-like) recess, the strand has a width that is measured crosswise to the plane of the glass pane and that is smaller than the width of the strand in its area lying outside of the cavity.

In order to facilitate the closing and pressing-in of the depression for the production of the area of the spacer with decreased width, it can be provided to heat the material of the strand that forms the spacer.

With the device according to the invention, depressions allowing pressure compensation during compression of insulating glass blanks can be produced in spacers even at some distance from a joint, i.e., in uninterrupted and closed areas of the strand that forms the spacer.

Within the framework of the invention, at least one of the jaws can be provided with at least one recess arranged in its surface to be placed on the strand, so that space is formed into which excess material can overflow when the beginning and the end are closed using the jaws, and the depression is molded-in using the die. This at least one recess is preferably only provided in the jaw that is placed on the outside of the strand.

In a possible embodiment of the invention, it is provided that the depression is made as a decrease in width in places of the strand that forms the spacer.

In a possible embodiment of the invention, it is provided that the depression is made with a concave outside surface.

In a possible embodiment of the invention, it is provided that the jaws are equipped with a heating unit.

Figure 2:
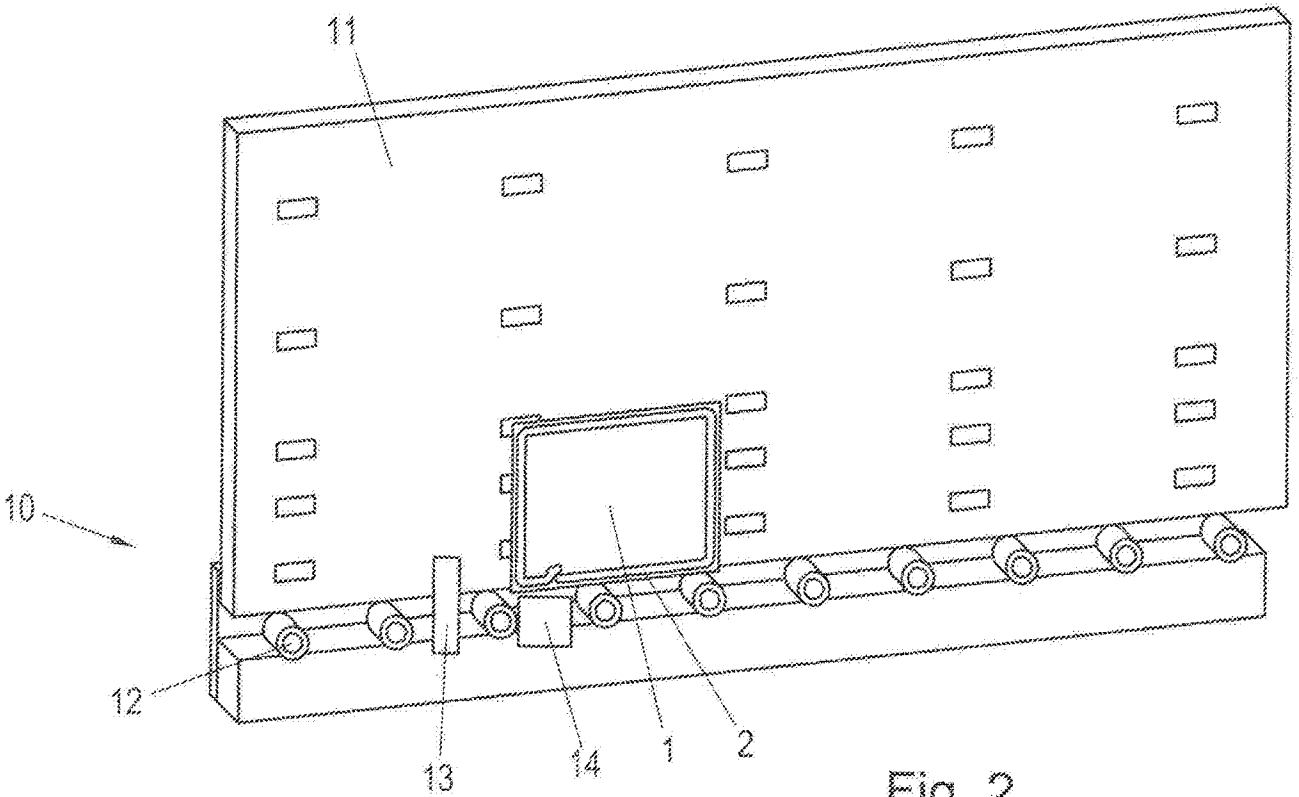
Figure 3:
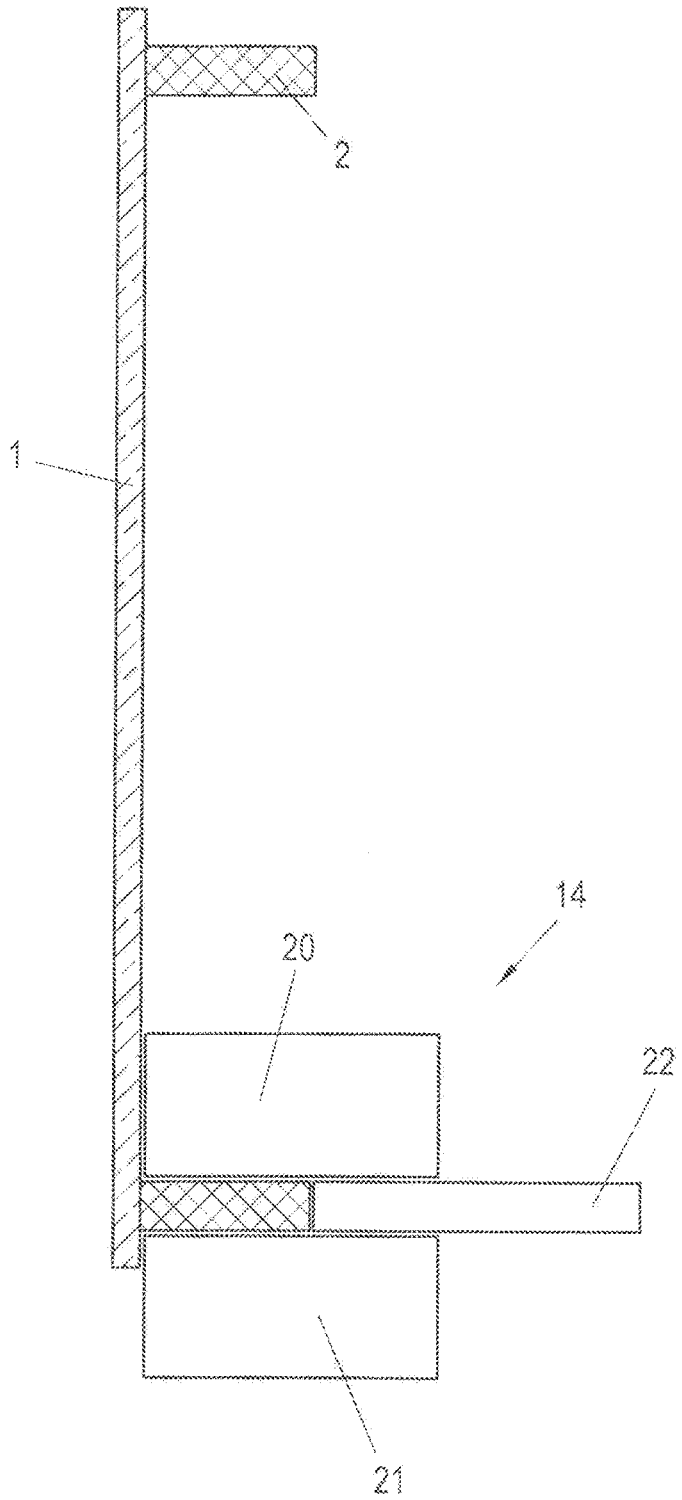
Figure 4:
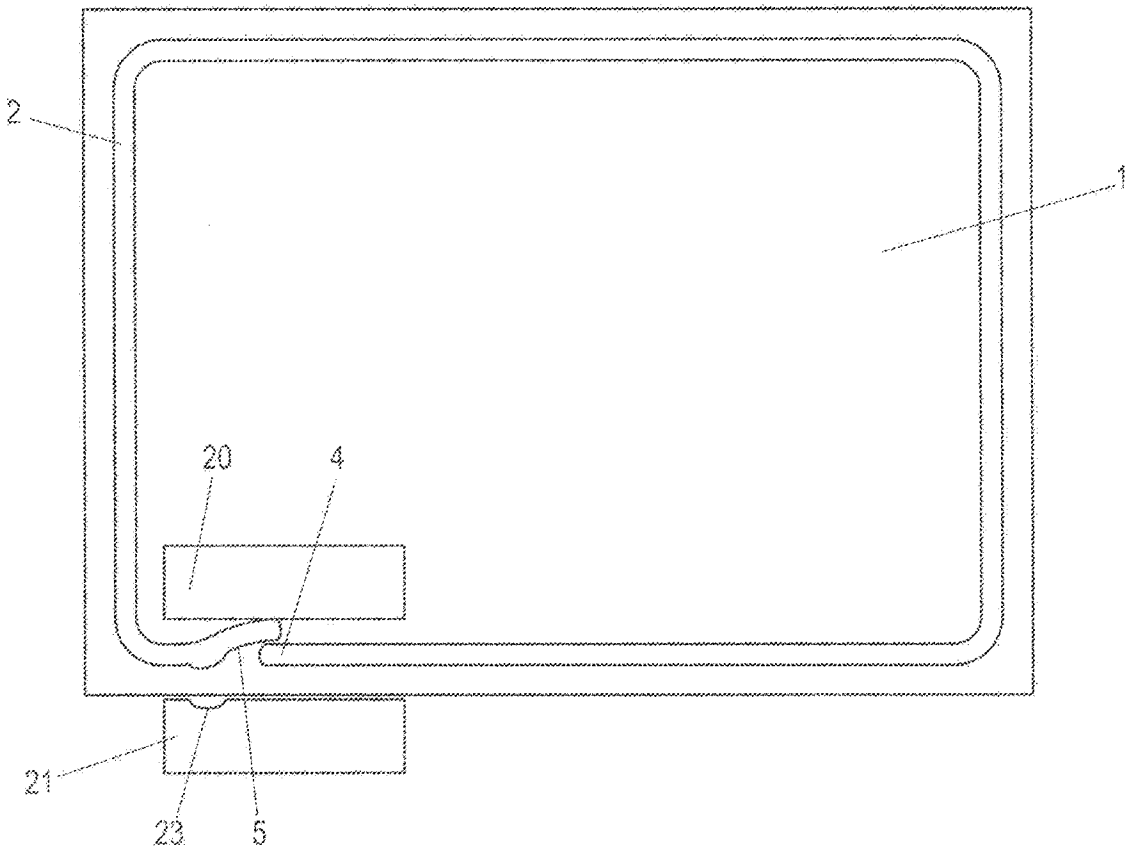
Figure 5:
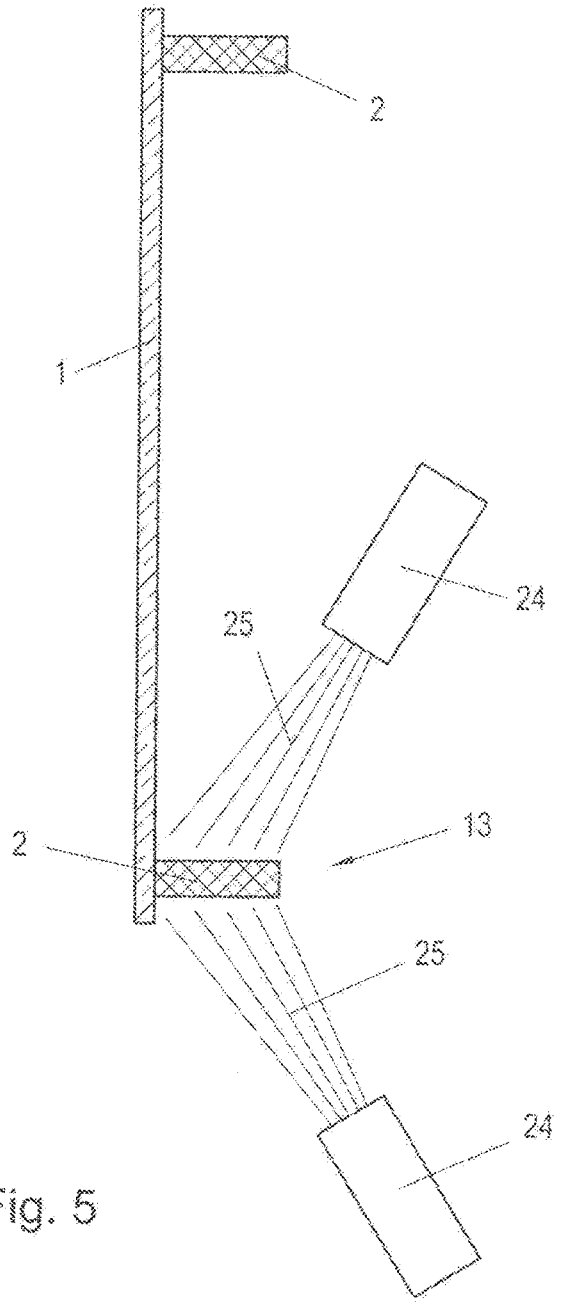
Figure 6:
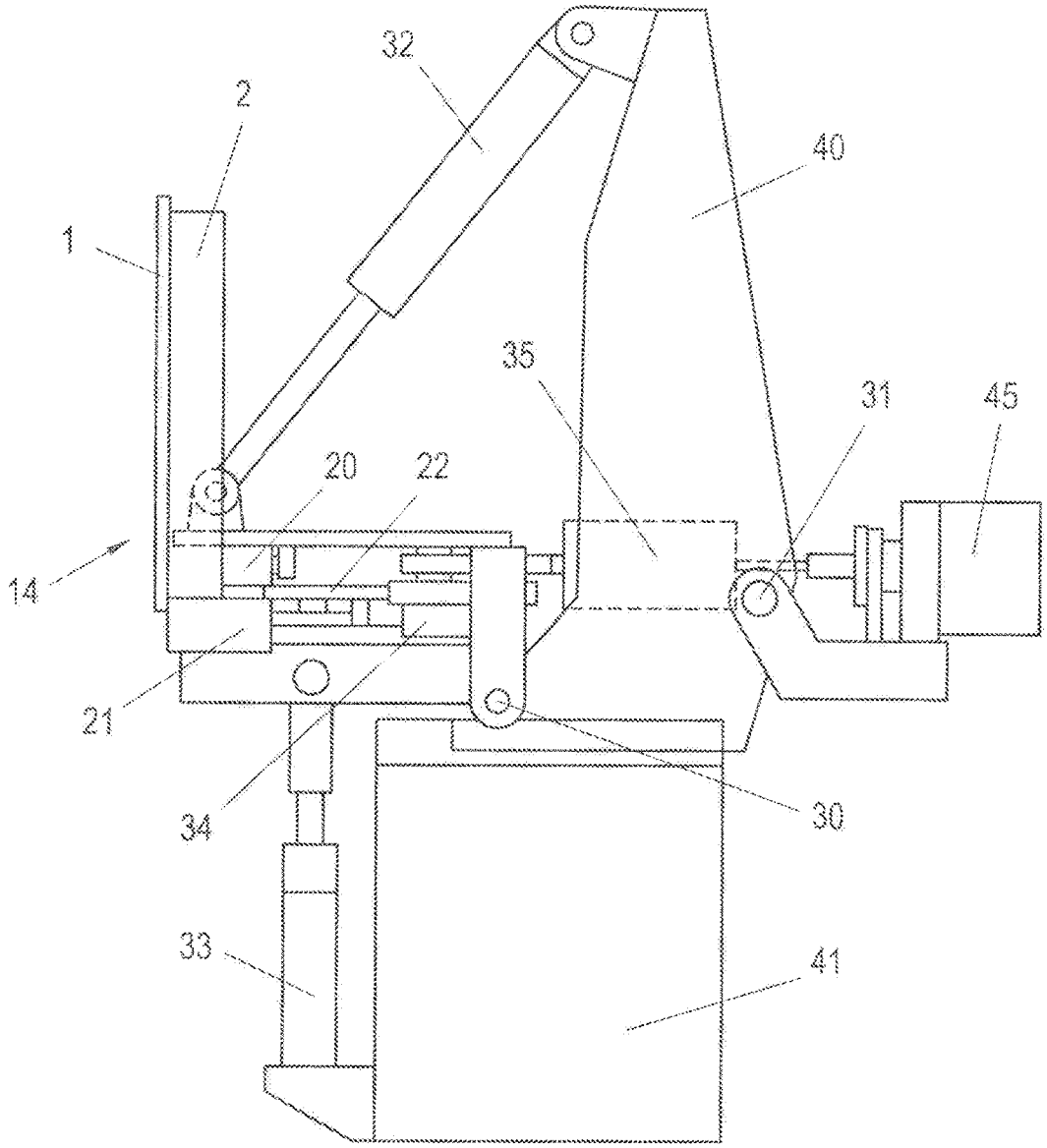
Figure 7:
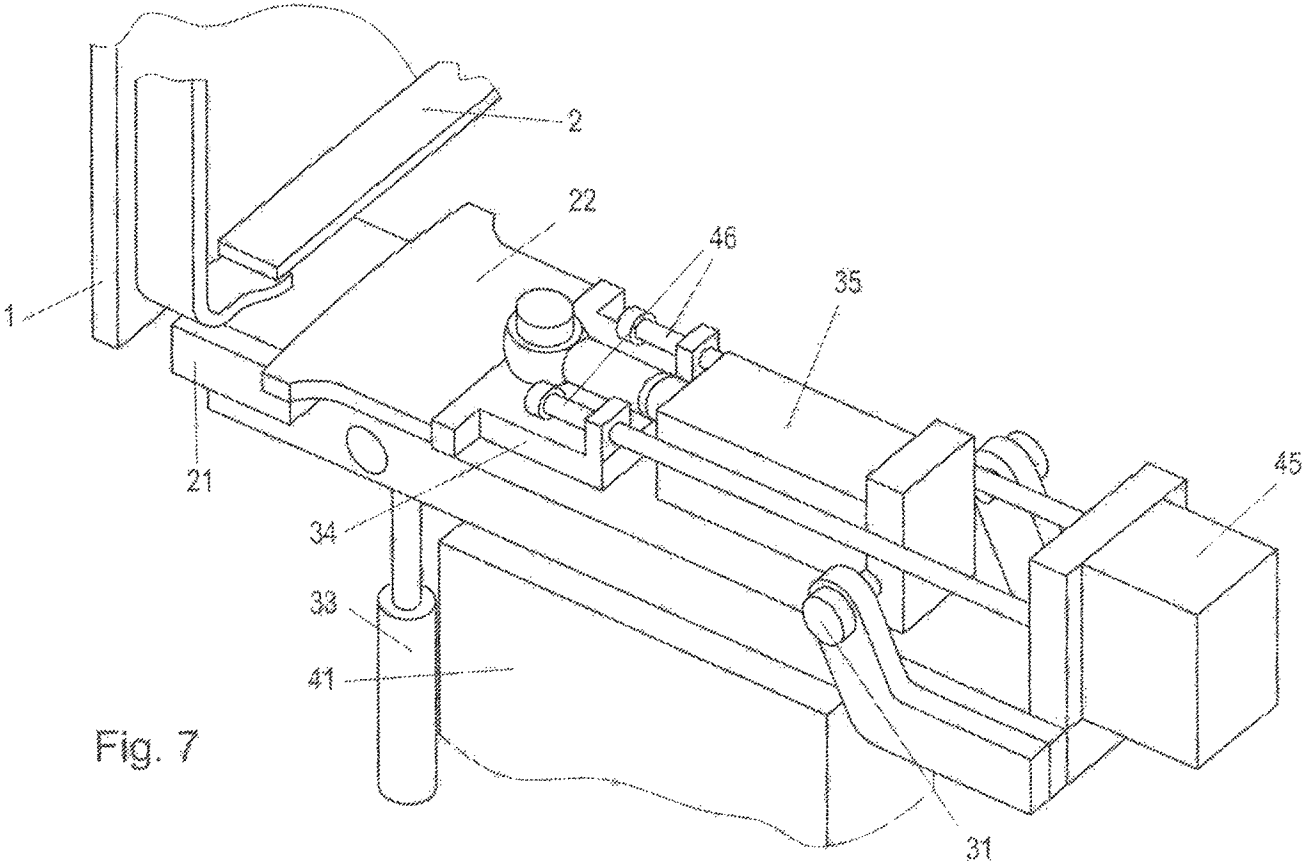
Figure 8:
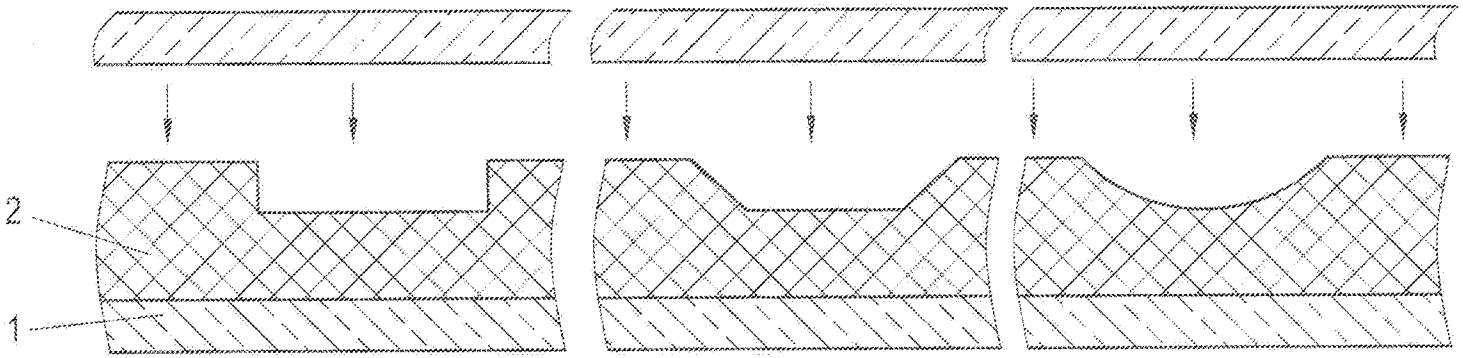

Additional details, features and advantages of the method according to the invention, on the one hand, and the device according to the invention, on the other hand, are given in the description below of preferred embodiments based on the partial diagrammatic drawings. Here:

FIG. 1 shows in a view a glass pane with applied spacers, whose beginning and end are not yet closed, FIG. 2 shows a device with which the method according to the invention can be carried out, FIG. 3 diagrammatically shows the basic structure of a device according to the invention, FIG. 4 shows, with parts not shown, the jaws as for closing the beginning and the end of the spacer, FIG. 5 diagrammatically shows an arrangement for heating a spacer from the beginning and the end, FIG. 6 shows in side view an embodiment of a device according to the invention, FIG. 7 shows the embodiment of FIG. 6 in oblique view and without the jaw that is to be placed on the strand from inside, and FIG. 8 shows possible shapes of the depression in the spacer.

FIG. 1 shows a glass pane 1, on which a spacer has been applied in the form of a strand 2 made of thermoplastic material at some distance from the edge 3 of the glass pane 1. FIG. 1 also shows that the beginning 4 and the end 5 of the strand 2, which forms the spacer, overlap, whereby the end 5 of the strand 2, relative to the glass pane 1, is arranged preferably inside the beginning 4 of the strand. In this case, the beginning 4 of the strand 2 is applied on the glass pane in such a way that it is at least approximately in alignment with the other spacer.

FIG. 2 shows a device 10, in which the beginning 4 and the end 5 of the strand 2 that forms the spacer can be connected to one another in order to close the spacer. The device 10 comprises a support wall 11, e.g., a roller support wall or air-cushion support wall, on whose lower edge a conveying system 12 is provided in the form of a roller conveyor or a conveyor belt. The conveying system 12 is driven by a servomotor. The glass pane 1 with an applied strand 2 that forms the spacer is moved into the position of a system 13 for heating the beginning 4 and the end 5 of the strand 2, then into the position of a unit 14, with which the beginning 4 and the end 5 of the applied strand 2 that forms the spacer are tightly connected to one another. Finally, the glass pane 1 with a closed spacer is further conveyed into a station (not shown) for the assembly of an insulating glass blank (optionally with filling with a gas other than air).

The system 13 for heating and the unit 14 are arranged in their active position with a roller conveyor between adjacent rollers. In the case of a conveying system 12 comprising conveyor belts, the system 13 and the unit 14 are arranged in gaps in the conveying system, for example between conveyor belt sections, or the conveyor belt is deflected downward in the area of the system 13 and/or the unit 14.

Usually, the beginning 4 and the end 5 of the strand 2 that form the spacer have to be heated only after shutdowns in order to make possible a secure and tight connection of the same.

As shown in FIG. 3, for connecting the beginning 4 and the end 5 of the strand 2 that forms the spacer, the unit 14 comprises two jaws, namely an inner jaw 20 and an outer jaw 21, which are placed from both sides adjacent to the beginning 4 and the end 5 of the applied strand 2 in order to compress the latter. A die 22, which can be advanced between the jaws 20, 21 to produce an area with decreased width of the strand 2 that forms the spacer, is provided between the jaws, i.e., between the inner jaw 20 and the outer jaw 21.

FIG. 4 again shows the jaws 20, 21 to which the beginning 4 and the end 5 of the applied strand 2 are assigned. FIG. 4 also shows that the jaws 20, 21 can be assigned heating units 13, e.g., in the form of integrated heat elements, in order to heat the jaws 20, 21 to a temperature that is proper for the processing of the thermoplastic material, of which the strand 2 that forms the spacer consists.

The heating units 13 assigned to the jaws 20, 21 are provided as desired as an alternative or in addition to the heating units 13 that is designed as, for example, hot-air blowers.

FIG. 4 also shows that at least one jaw, in the example shown this is the outer jaw 21, has a groove-shaped recess 23 (depression), into which excess material of the strand 2 can flow when the beginning 4 and the end 5 of the applied strand 2 are compressed for connection and the die 22 is advanced to produce the depression, i.e., the area with decreased width of the spacer.

FIG. 5 diagrammatically shows an example of a unit 13 for heating the beginning 4 and the end 5 of the strand 2 before the connection, with which the material (thermoplastic material) of the strand 2 can be heated to the temperature that is proper for closing. In the embodiment shown, in the case of the device 13 for heating, two nozzles 24, which release a hot gas flow 25, e.g., hot air, are provided.

In the practical, exemplary embodiment of a unit 14 provided in the device according to the invention, as is shown in FIGS. 6 and 7, the jaws, namely the inner jaw 20 and the outer jaw 21, are mounted so as to pivot around axes 30 and 31 in the machine frame 40. The jaws can be placed using pressure medium cylinders 32, 33 (pneumatic cylinders) on the inside and the outside of the beginning 4 and the end 5 of the applied strand 2.

FIG. 7 shows that the outer jaw 21, i.e., the jaw that is placed on the outside of the strand 2 in the area of its beginning 4 and end 5, in its side that faces the strand 2, has multiple free positions in the form of groove-shaped or furrow-shaped recesses 23 (as shown in FIG. 4), into which excess material of the strand 2 can flow when the beginning 4 and the end 5 are compressed and using the die 22 of the depressed area, i.e., the section of the strand 2 with decreased width is produced.

The die 22 is mounted on a slide 34, which can be pushed forward and back using a pressure medium cylinder 35 (pneumatic cylinder). The slide 34 of the die 22 is guided on the carrier 35 of the outer jaw 21, which can be pivoted around the axis 31 by a pressure medium motor 33. As illustrated on FIG. 7, slide 34 of die 22 is arranged on two rods 46 extending from a block 45 provided on the machine frame 40. Stops are provided on rods 46 for limiting the movement of slide 34 and die 22.

FIG. 7 shows that the forward front surface of the die 22 is curved in a convex manner in such a way that a cavity-shaped depression, which forms the area with decreased width of the strand 2 that forms the spacer, is produced when the die 22 is advanced between the jaws 20, 21, which have been placed on the inside and the outside of the strand 2 in the area of its beginning 4 and end 5.

In FIG. 8, possible shapes of the depressions provided in the strand 2 that forms the spacer are depicted in side view (i.e., seen in the direction of the plane of the glass pane 1). The cavity-shaped form of the depression, i.e., bounded by a (circular) arc, which is shown on the right in FIG. 8, is preferred compared to a depression with a rectangular or trapezoidal cross-section.

The assembly with the jaws 20, 21 and the die 22 that can be advanced between the latter and with the drives thereof, forming the unit 14, is mounted on a carrier 41, which can be adjusted crosswise to the plane of the glass pane 1 and crosswise to the support wall 11 according to FIG. 2 in order to push the jaws 20, 21, after a glass pane 1 with applied strand 2 of the unit 14 has been positioned opposite, so far that the jaws 20, 21 are arranged beside the inside and on the outside of the strand 2, as is shown in FIGS. 3 and 6 for jaws 20, 21 already placed on the strand 2.

The assembly ("closure unit") that forms the unit 14 is additionally adjustable in a direction that is parallel to the glass pane 1, so as to match the position of the jaws 20, 21 and the die 22 on the strand 2—the latter can be arranged more or less offset inward compared to the edge of the glass pane 1.

In summary, an embodiment of the invention can be described as follows:

During production of insulating glass, comprising at least two glass panes 1 and at least one spacer made of thermoplastic material arranged between the glass panes, the closing of the beginning 4 and the end 5 of the strand 2 made of thermoplastic material that forms the spacer compresses the thermoplastic material using jaws 20, 21 that are placed on the lateral surfaces of the strand 2. In the area of the thus closed joint between the beginning 4 and the end 5 of the strand 2, the width of the strand 2 is scaled-down when producing a depression using a compression die 22 with a convex, curved active surface. Because of this depression, an opening, which allows pressure compensation during subsequent compression of the insulating glass blank, is produced after the assembly of an insulating glass blank by putting a second glass pane on the free edges of the strand 2.

The invention claimed is:

1. A method for producing spacers, comprising: mounting a strand (2) made of thermoplastic material on upon a glass pane (1); and connecting a beginning (4) and an end (5) of the strand (2) to one another such that in an area of a joint of the strand where the beginning (4) and the end (5) of the strand (2) are connected to one another, a depression is produced in the strand, said depression being formed by deforming the strand (2) simultaneously with the connecting of the beginning (4) and the end (5) of the strand (2), wherein the depression in the strand is formed by advancing a compression die (22) while jaws (20, 21) are applied to lateral surfaces of the strand (2) to connect the beginning (4) and the end (5) of the strand (2).

2. The method according to claim 1, wherein the compression die (22) has a convex, curved front surface.

3. The method according to claim 1, wherein the jaws (20, 21) and the compression die (22) engage upon a same portion of the strand (2).

4. The method according to claim 2, wherein the jaws (20, 21) and the compression die (22) engage upon a same portion of the strand (2).

* * * * *